US011208780B2

(12) United States Patent
Bohnhoff Harris et al.

(10) Patent No.: US 11,208,780 B2
(45) Date of Patent: Dec. 28, 2021

(54) MAT ESPECIALLY ADAPTED FOR USE WITH A SUBSURFACE FLUID AND PARTICULATE CONTAINER SYSTEM

(71) Applicant: BH Perpetual Holdings, LLC, Aurora, CO (US)

(72) Inventors: Olivia Bohnhoff Harris, Denver, CO (US); William Walter Bohnhoff, Culver City, CA (US)

( * ) Notice: Subject to any disclaimer, the term of this patent is extended or adjusted under 35 U.S.C. 154(b) by 0 days.

(21) Appl. No.: 17/313,163

(22) Filed: May 6, 2021

(65) Prior Publication Data

US 2021/0372068 A1 Dec. 2, 2021

Related U.S. Application Data

(60) Provisional application No. 63/029,814, filed on May 26, 2020.

(51) Int. Cl.
*E02B 11/00* (2006.01)
*E03F 1/00* (2006.01)

(52) U.S. Cl.
CPC ..... *E02B 11/00* (2013.01); *E03F 1/002* (2013.01)

(58) Field of Classification Search
CPC ..... E01C 13/083; E02B 11/00; E03F 1/002; E03F 1/005
See application file for complete search history.

(56) References Cited

U.S. PATENT DOCUMENTS

| | | | | | |
|---|---|---|---|---|---|
| 5,848,856 | A * | 12/1998 | Bohnhoff | E02B 11/00 | 405/36 |
| 6,428,870 | B1 * | 8/2002 | Bohnhoff | E02B 11/00 | 405/50 |
| 7,201,538 | B2 * | 4/2007 | Blackwood | E01C 13/083 | 404/36 |
| 8,398,332 | B2 * | 3/2013 | Allen | E01C 9/004 | 404/70 |
| 8,602,681 | B1 * | 12/2013 | Masser | E03F 1/005 | 405/43 |
| 8,696,241 | B2 * | 4/2014 | Lee | E01C 3/06 | 405/39 |
| 8,753,037 | B2 * | 6/2014 | Hewing | E03F 1/005 | 405/52 |
| 9,303,365 | B2 * | 4/2016 | Gooden | E01C 5/001 | |
| 10,352,002 | B2 * | 7/2019 | Son | E01C 5/005 | |
| 10,731,303 | B2 * | 8/2020 | Lingle | E01C 11/02 | |
| 10,941,577 | B1 * | 3/2021 | Bennett | E01C 9/086 | |
| 2012/0255624 | A1 * | 10/2012 | Canney | E03F 1/002 | 137/315.01 |
| 2019/0145112 | A1 * | 5/2019 | Gooden | E03F 1/002 | 404/17 |

* cited by examiner

*Primary Examiner* — Benjamin F Fiorello

(57) ABSTRACT

Tubular segments may be nestably interconnected, with the lower end of one tubular segment inserted into the upper end of another tubular segment. A mat formed of such tubular segments, and a system formed of a plurality of such vertically stacked mats for containing fluids and particulate material, are also disclosed.

21 Claims, 7 Drawing Sheets

MAT ESPECIALLY ADAPTED FOR USE WITH A SUBSURFACE FLUID AND PARTICULATE CONTAINER SYSTEM

REFERENCE TO RELATED APPLICATIONS

The present invention claims the benefit of priority to the inventors' U.S. Provisional Patent Application No. 63/029,814, filed May 26, 2020, having the ride "Improved Mat Especially Adapted For Use With a Subsurface Fluid Drainage and Storage System". The subject matter of that provisional patent application is incorporated by reference.

FIELD OF THE INVENTION

The present invention relates to systems for containing fluids and particulate material, especially to a system for vertically stacking in a nested relation mats suited for storing rain and irrigation water drainage on and/or below the land's surface. The present invention also relates to macs that are suited for use in such systems and to tubular segments for implementation in such mats.

The present invention is directed to an improved mat and tubular segments, especially an improvement over the mats and tubular segments disclosed in U.S. Pat. No. 6,428,870 to William W. Bohnhoff issued Aug. 6, 2002. The subject matter of the '870 patent as well as the subject matter of U.S. Pat. No. 8,182,179 also to William W. Bohnhoff issued May 22, 2012 are completely incorporated herein by reference.

BACKGROUND OF THE INVENTION

The Bohnhoff patents generally disclose a square-shaped mac comprising a fixed array of tubular support members. A first longitudinal end of each support member in a mat includes a compression fitting, and the other, second longitudinal end includes a receiving end. The lower longitudinal end of a support member in a mat is adapted to be axially inserted into the upper receiving end of a support member in an underlying mat thereby to create a compression fitting such that the mats may be nestably stacked in a way that also inhibits lateral movement of the mats relative to each other.

SUMMARY OF THE INVENTION

The present invention is directed to improvements on the basic inventions disclosed in the Bohnhoff patents. In one aspect, the invention discloses a means for attaching adjacent, overlapping mats, and particularly attaching together at least some of the tubular support members in adjacent mats. In another aspect, the invention discloses a mat with an array of tubular support members whereby adjacent, overlapping mats may be staggered or placed orthogonally with respect to each other.

While the foregoing summary highlights some preferred features and advantages of the instant invention, the summary should not be construed as limiting the nature of the invention.

BRIEF DESCRIPTION OF THE DRAWINGS

The invention will be described with reference to the accompanying drawings, wherein.

DESCRIPTION OF A PREFERRED EMBODIMENT

Figure 1A:
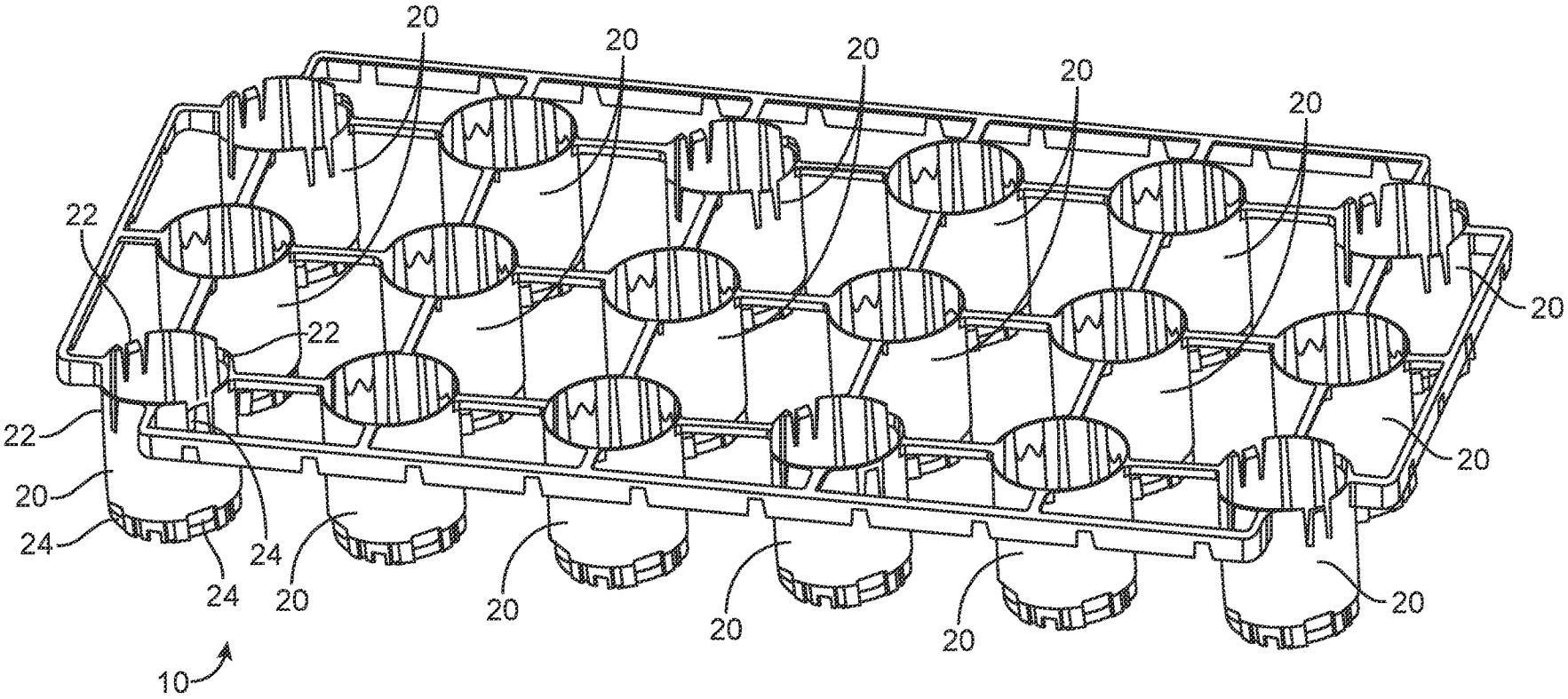
FIG. 1*a* is a perspective view of a mat in accordance with one embodiment of the invention that includes a six by three array of tubular members.

The present invention wall be described with reference to the accompanying drawings wherein like reference numerals refer to the same item. It should lac appreciated that the following description is intended to be exemplary only, and the scope of the invention envisions other variations and modifications of these particular exemplary embodiments.

Figure 1B:
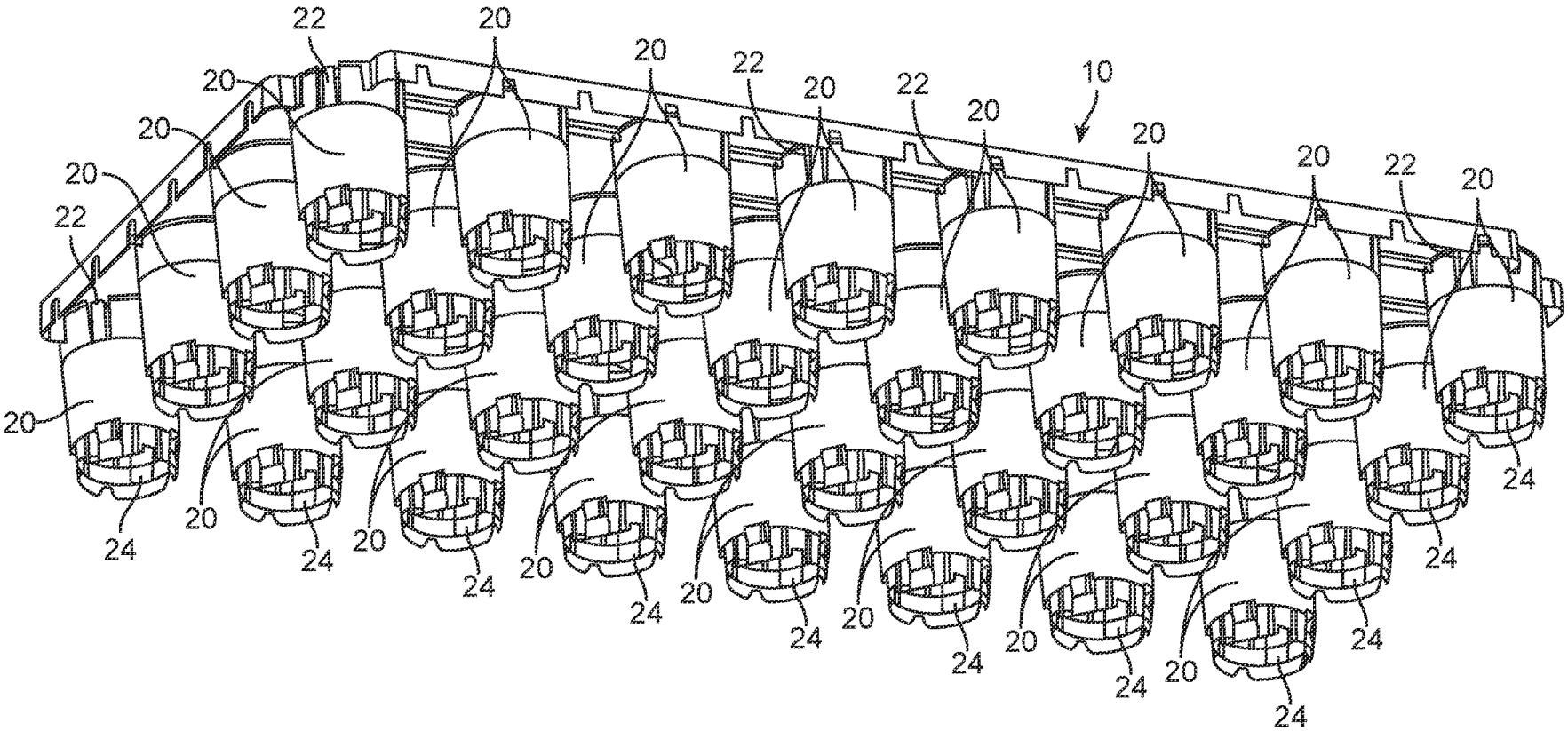
FIG. 1*b* is a perspective view of another mat in accordance with another embodiment of the present invention that includes an eight by four array of tubular members.
Figure 5:
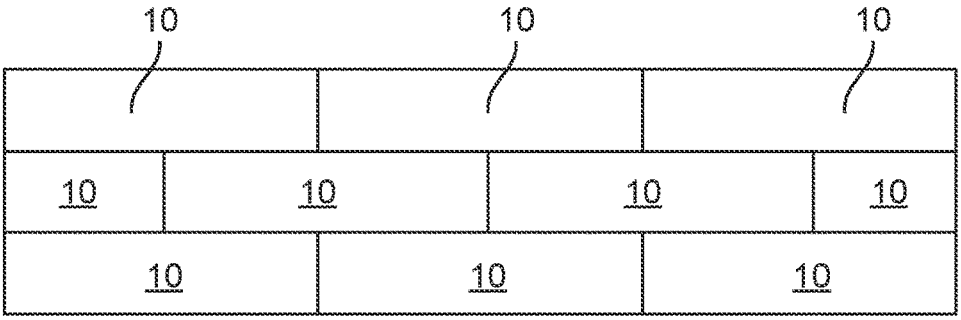
FIG. 5 is a schematic illustration of a side view of several vertically stacked mats, such as the mats shown in FIGS. 1*a* and 1*b*, each represented by a rectangle, and depicting how the mats may be staggered along a plane or extending in orthogonal directions relative to adjacent mats.
Figure 6:
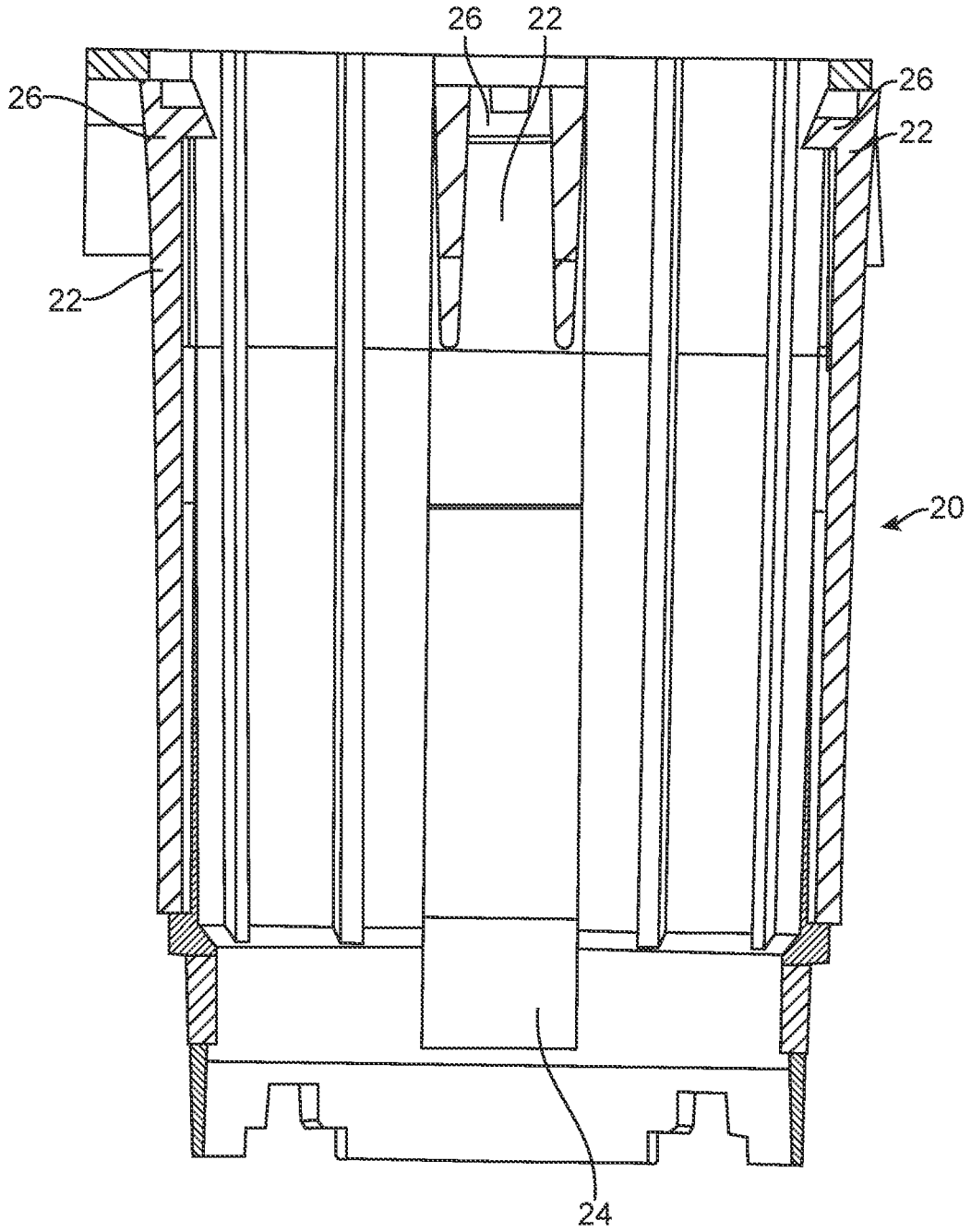
FIG. 6 is a schematic illustration of a tubular member in accordance with an embodiment of the present invention taken along a vertical cross-section.
Figure 7:
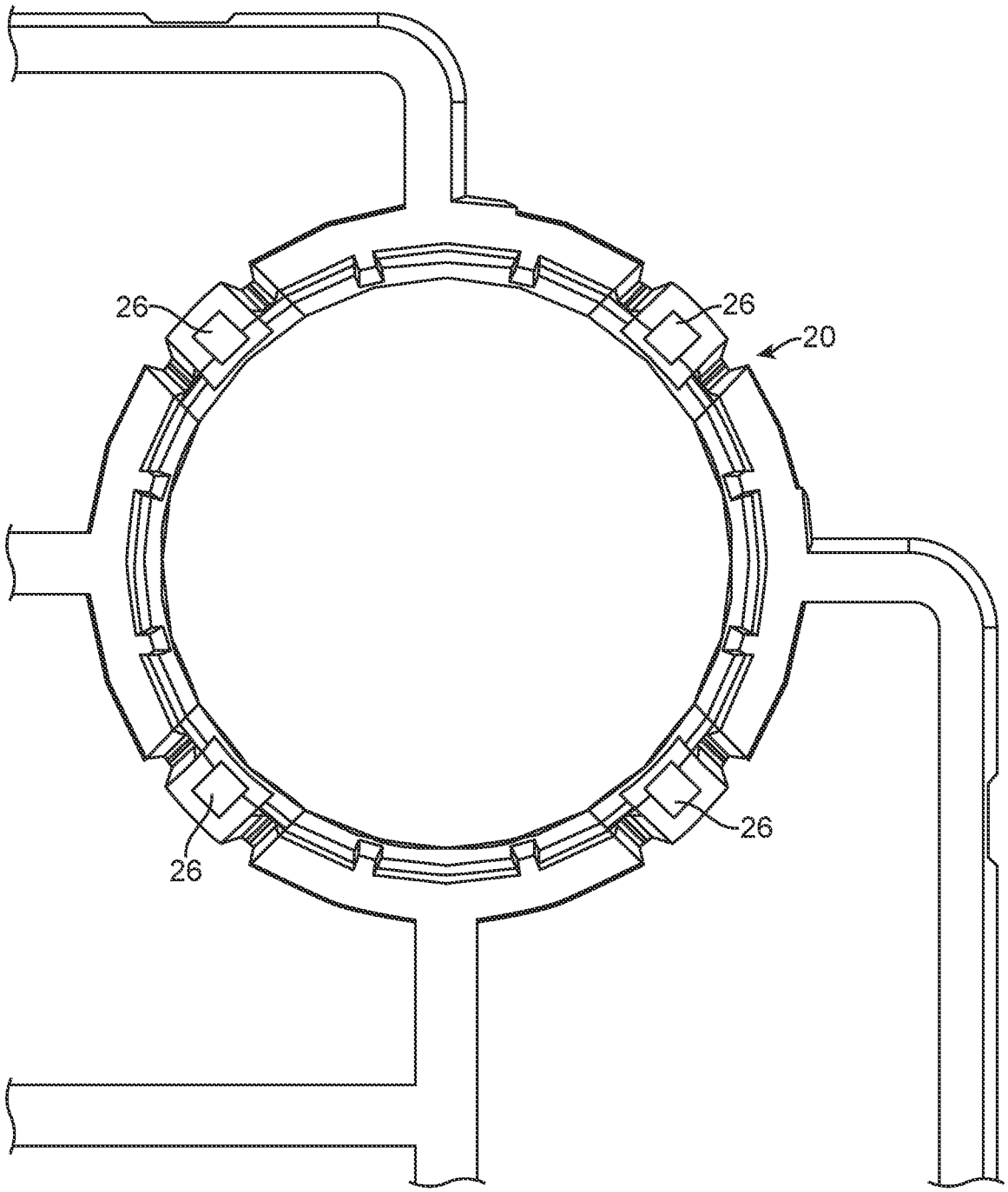
FIG. 7 is a schematic illustration of a cutaway top view of a portion of the mat shown in either of FIGS. 1*a* and 1*b*, highlighting a top view of a tubular member.
Figure 8:
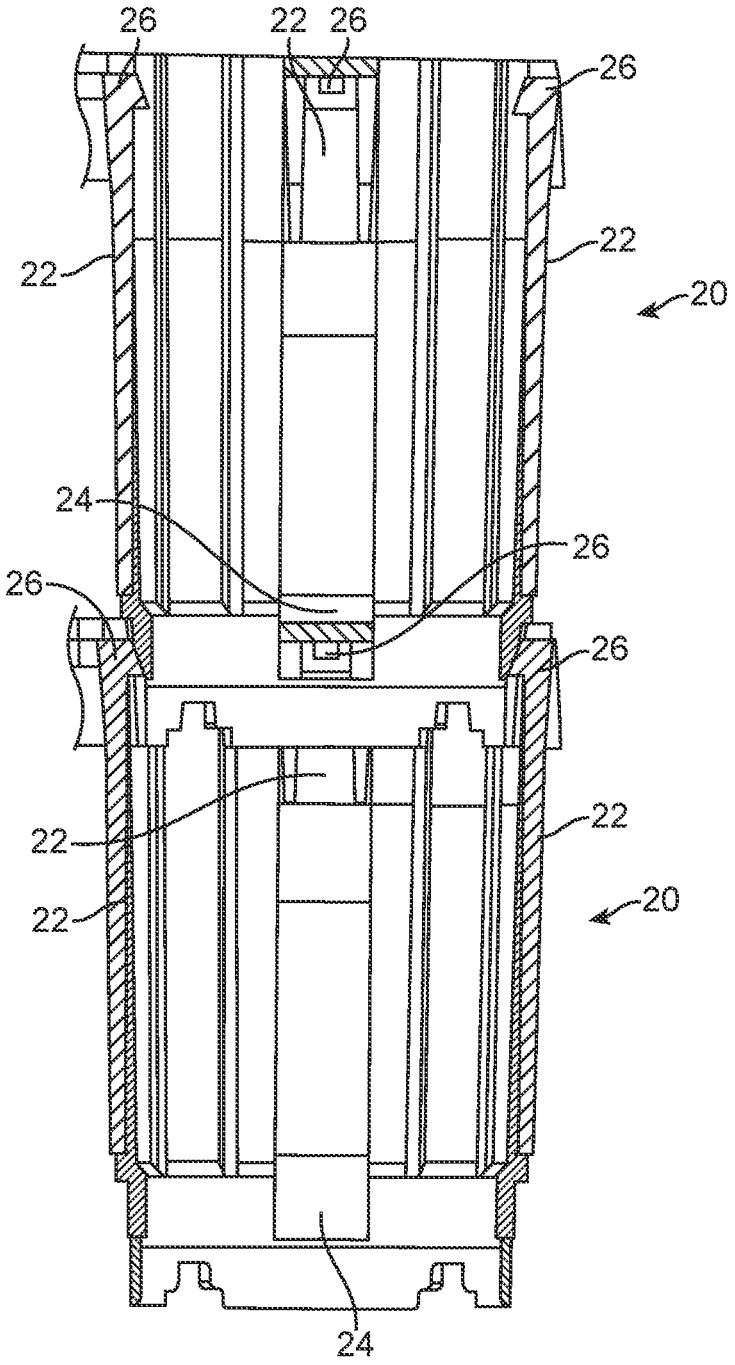
FIG. 8 is a schematic illustration of two nested tubular members in adjacent, overlapping mats such as those shown in either of FIG. 1*a* or 1*b*, taken along a vertical cross-section.
Figure 9:
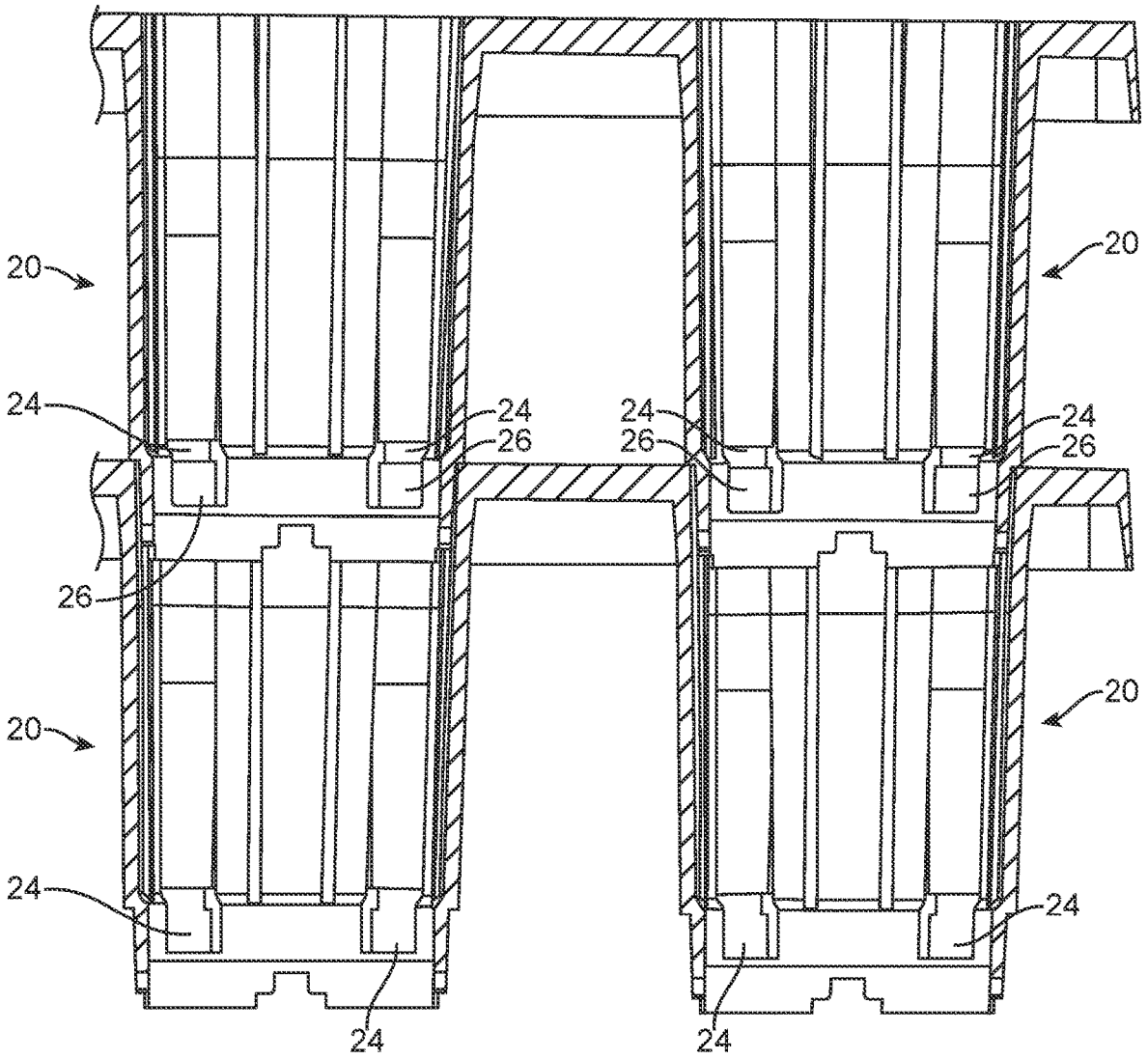
FIG. 9 is a schematic illustration of two pairs of adjacent nested tubular members in adjacent, overlapping mats such as those shown in either of FIG. 1*a* or 1*b*, taken along a vertical cross-section.

The square mat as shown in FIG. 1 of the '870 Bohnhoff patent includes a six by six array of support members. There is shown in FIGS. 1*a* and 1*b* mats 10 in accordance with the present invention. The mats 10 are essentially identical except that the mat 10 in FIG. 1*a* possesses a six by three array of tubular support members 20, whereas the mat 10 shown in FIG. 1*b* possesses an eight by four array of tubular support members 20. The present invention contemplates that the overall mat 10 preferably possesses a rectangular, rather than a square, profile with the width of the rectangle preferably being one-half the length. In other words, the present invention contemplates preferably a mat 10 in which there are N tubular support members 20 in columns along the length of the mat 10 and one-half N tubular support members 20 in rows across the width of the mat 10, with each tubular support member 20 spaced an equal distance lengthwise and widthwise from every adjacent tubular support member 20. The rectangular configuration of the present mat 10 permits each mat 10 not only to be staggered with respect to a mat 10 immediately above or below that mat 10, in different layers of mats 10, but also permits a mat 10 to be arranged orthogonally with respect to other mats 10 in the same layer of mats 10, as shown schematically in FIG. 5 of the accompanying drawings. In this sense, the invention permits overlapping mats 10 to be arranged like the well-known LEGOS® plastic construction toys. By permitting the mats 10 to be arranged either in a staggered configuration or orthogonally with respect to each other, the strength of the overall structure of mats 10 is increased, and the overall configuration will better resist displacement or alteration from any forces, especially lateral forces, applied to the structure.

The present invention contemplates that the tubular support members 20 in a mat 10 in one layer may be connected with tubular support members 20 in a mat 10 in an adjacent layer by use of the compression fitting previously described in the Bohnhoff '870 patent or in addition, or alternatively, may include a male prong 22 and female receptacle 24. Preferably each tubular support member 20 includes four equiangularly arranged female receptacles 24 in the lower longitudinal end thereof, which receptacles 24 may preferably be in the form of a rectangular opening, as best shown in FIGS. 1*a*, 1*b*, 3, 4, and 6-9. Preferably at least some, and even all, of the support members 20 in a mat 10 include four equiangularly arranged male prongs 22 in the upper end thereof, each prong 22 being adapted to be selectively inserted and to be retained in a corresponding receptacle 24. Although four receptacles 24 and four prongs 22 are the preferred number per support member 20, the invention contemplates that any number of such receptacles 24 and prongs 22 may be utilized. Also preferably the receptacles 24 and the prongs 22 are equiangularly arranged about the longitudinal axis of the tubular support member 20, but need not be equiangularly arranged. Also, although preferably a tubular support member 20 possesses cylindrical interior and exterior walls, the invention also contemplates that other configurations may be utilized.

Figure 3:
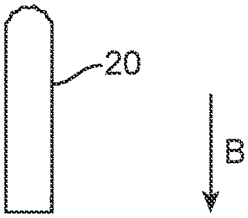
FIG. 3 is a schematic illustration of the prong shown in FIGS. 2*a*-2*d* moving toward an aperture in a vertically adjacent tubular member, and depicting the barbed distal end in a flexed condition.
Figure 3:
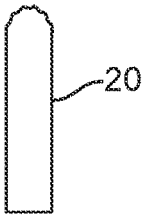
Figure 3:
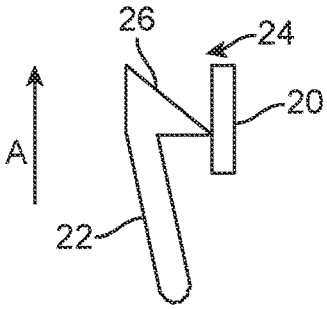
Figure 4:
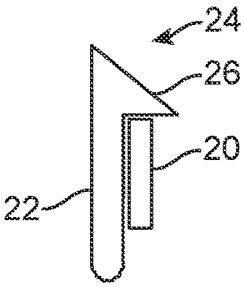
FIG. 4 is a schematic illustration of the prong shown in FIG. 3 in which the barbed distal end thereof is aligned with the aperture in a vertically adjacent tubular member, has returned to its unflexed state, and extends into the aperture.

FIGS. 2*a-d* show respectively a side view, a from view, a rear view, and an opposite side view of a cut-away segment of a prong 22 in accordance with a preferred embodiment of the present invention. The upper, distal end of each prong 22 is preferably shaped in the form of an arrow point or barb 26. FIGS. 3 and 4 schematically show the process of connecting tubular support members 20 in overlying mats 10. A prong 22 in a tubular support member 20 in lower mat 10 is moved upwardly in the direction of arrow A relative to a receptacle 24 in a tubular support member 20 in an upper mat 10, moving in the relative direction of arrow B. As best shown in FIG. 3, when the two support members 20 are moved in the relative directions of the arrows A and B, the sloped or beveled upper surface of the barb 26 on the prong 22 forcibly contacts the lower end of the tubular support member 20 below the receptacle 24 and is thereby deflected radially outward such that the radially inward point of the barb 26 tides along the outer periphery of the tubular support member 20 in the region below the receptacle 24. Further movement in the directions of arrows A and B causes the barb 26 to spring back to an un flexed condition and into the opening of the receptacle 24. The barb 26 is thus retained in the receptacle 24, and prevented from movement opposite to arrows A and B, by the lower edge of the barb 26 coming into abutment with the lower defining wall of the receptacle 24. When the barb 26 is thus retained in the receptacle 24, the two support members 20 are connected to each other. It will be appreciated that the receptable 24 may comprise a barb-receiving structure, such as an aperture extending through, or a notched indentation in, the wall of the tubular support member 20. Thus, the invention contemplates a means for attaching adjacent, aligned tubular support members 20 that preferably includes a barbed prong and a cooperating barb-receiving structure.

Figure 2A:
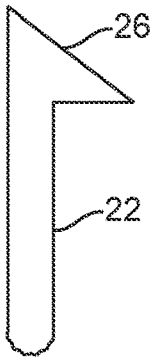
FIGS. 2*a*-2*d* are cutaway first side, front, back, and opposite side views of a prong or finger possessing a barbed distal end included in a tubular member in accordance with an embodiment of the invention.
Figure 2B:
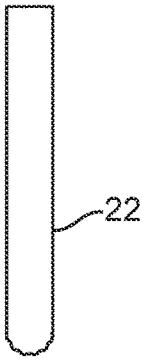
Figure 2C:
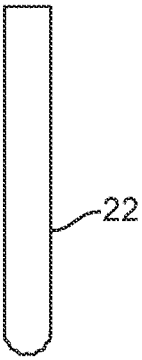
Figure 2D:
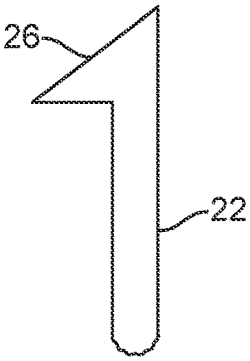

It will be appreciated that the prong 22 is fashioned of a plastic or other material that permits flexing and bending in a spring-like manner under pressure such that the prong 22 will return to its normal state as shown in FIGS. 2*a* and 2*d* when the pressure is released. It will also be appreciated that one may cause the barb 26 to be pressed, such as manually, m a radially outward direction, while simultaneously moving the prong 22 and the support member 20 in the directions opposite to arrows A and B, whereby the two support members 20 may be disconnected.

The invention also contemplates that all or less than all of the support members 20 in each mat may have prongs 22. For example, as shown in FIG. 1*a*, the first, fourth, and sixth support members 20 in the nearest row of the array may include prongs 24, the support members 20 in the middle row may contain no prongs 22, and the first, third, and sixth support members 20 in the farthest row may include prongs 22. Alternatively, the tubular support members 20 in each of the four corners of the array in each mat 10, and no other tubular support members 20, may include prongs 24.

As with the mats and the systems disclosed in the Bohnhoff '179 patent, each mat 10 of the present invention may be integrally formed, such as with a plastic material, including a plastic such a polypropylene, and the stacked mats 10 may be encased in one or more sheet layers, such as geotextile fabrics and those impervious to fluids. As also disclosed in that Bohnhoff patent, the systems (encased with one or more sheer layers) may be employed to store water, especially potable water, to prevent erosion such as occurs with sand dunes and levees, and to provide a load-bearing structure such as for a roof or a budding foundation. For these two latter functions, the system may be filled with particulate material. The systems of the present invention may also be filled with air or another gas and used to provide floating structures such a buoys, floating dock supports, and barges. The present invention also contemplates the system (with one or more encasing sheets) may be employed for containing fluids used in connection with flow batteries.

While various embodiments of the present invention have been described herein, it will be appreciated that the invention includes embodiments other than those specifically illustrated or described and that changes in the form and arrangement of parts and the specific manner of practicing the invention may be varied without departing from the nature or scope of the invention. Consequently the invention may be practiced otherwise that is specifically described above.

We claim:

1. A tubular segment having a substantially longitudinal axis and configured for nestable interconnection with another essentially identical tubular segment, whereby when said tubular segment is nestably interconnected with another essentially identical tubular segment, both said tubular segments are substantially aligned along said longitudinal axis, said tubular segment including:

an upper end and a lower end, said lower end being configured to longitudinally extend into the upper end of another essentially identical tubular segment, a wall of said tubular segment including at least one barb-receiving structure and at least one prong including a barb, said at least one barb-receiving structure and said at least one prong positioned and configured whereby when said tubular segment is nestably interconnected with another essentially identical tubular segment, said barb of said at least one prong protrudes into said at least one barb-receiving structure of said nestably interconnected, essentially identical tubular segment, thereby attaching said nestably interconnected tubular segments and substantially preventing said nestably interconnected tubular segments from movement with respect to each other along said longitudinal axis.

2. The tubular segment according to claim 1 wherein said tubular segment includes at least four of said prongs each including said barb and at least four of said barb-receiving structures.

3. The tubular segment according to claim 2 wherein said prongs and said barb-receiving structures are equiangularly spaced about said longitudinal axis.

4. The tubular segment according to claim 3 wherein said tubular segment possesses a substantially cylindrical exterior periphery and a substantially cylindrical interior periphery, thereby forming a substantially cylindrical tubular wall, and wherein said prongs and said barb receiving structures are substantially coextensive with said wall.

5. The tubular segment according to claim 1 wherein said at least one barb-receiving structure is formed by a notch in said cylindrical wall.

6. The tubular segment according to claim 1 wherein said at least one barb-receiving structure is formed by an aperture extending through said wall.

7. The tubular segment according to claim 1 wherein said barb is integrally formed with said at least one prong and is positioned on an extending distal end of said at least one prong.

8. The tubular segment according to claim 7 wherein said extending distal end of said at least one prong is flexible and resilient in a direction radial to said longitudinal axis.

9. The tubular segment according to claim 8 wherein said extending distal end of said at least one prong possesses a beveled profile, whereby forceful contact with said beveled profile causes said barb to move radially with respect to said longitudinal axis.

10. The tubular segment according to claim 1 wherein said tubular segment, including said at least one prong, is essentially integrally formed of a plastic material.

11. The tubular segment according to claim 1 wherein said tubular segment possesses an exterior periphery and an interior periphery, and said lower end possesses an exterior periphery substantially conforming to the interior periphery of said upper end.

12. A mat for creating a structurally supported region of space in which said mat is disposed, said mat including:

(a) a substantially planar, substantially quadrilateral grid formed by a plurality of substantially perpendicular struts;

(b) a plurality of upstanding substantially tubular members spaced uniformly on said grid, each tubular member having a substantially longitudinal axis and configured for nestable interconnection with another essentially identical tubular member, whereby when said tubular member is nestably interconnected with another essentially identical tubular member, both said tubular members are substantially aligned along said longitudinal axis, at least one of said tubular members characterized as an attaching tubular member including:

an upper end and a lower end, said lower end being configured to longitudinally extend into the upper end of another essentially identical tubular member, said attaching tubular member including means for attaching adjacent, aligned attaching tubular members whereby when said attaching tubular member is nestably interconnected with another essentially identical attaching tubular member, said attaching means attaches said essentially identical attaching tubular members and substantially prevents said essentially identical attaching tubular members from movement with respect to each other along said longitudinal axis such that when a plurality of said mats is substantially vertically stacked on top of each other, the lower end of said at least one attaching tubular member in a higher one of said mats nestably interconnects in the associated upper end of said at least one essentially identical attaching tubular member in the mat immediately therebeneath and said attaching means attaches said at least one attaching member in a higher one of said mats to said at least one essentially identical attaching tubular member in the mat immediately therebeneath.

13. The mat according to claim 12 wherein said struts and said tubular members are essentially integrally formed of a plastic material.

14. The mat according to claim 12 wherein said tubular members are disposed in a substantially uniform rectangular array defined by a plurality of substantially perpendicular rows and columns.

15. The mat according to claim 14 wherein the number of said tubular members in a row is one-half the number of said tubular members in a column.

16. The mat according to claim 12 including at least four attaching tubular members.

17. The mat according to claim 16 wherein less than half of said tubular members are characterized as an attaching tubular member.

18. A system adapted to contain a fluid, said system including:

(a) a plurality of vertically stacked mats, each said mat including:

(1) a substantially planar, substantially quadrilateral grid formed by a plurality of substantially perpendicular struts;

(2) a plurality of upstanding substantially cylindrical tubular members spaced uniformly on said grid, each tubular member having a substantially longitudinal axis and configured for nestable Interconnection with another essentially identical tubular member, whereby when said tubular member is nestably interconnected with another essentially identical tubular member, both said tubular members are substantially aligned along said longitudinal axis, at least one of said tubular member characterized as an attaching tubular member including:

an upper end and a lower end, said lower end being configured to longitudinally extend into the upper end of another essentially identical tubular member, said attaching tubular member including means for attaching adjacent, aligned attaching tubular members whereby when said attaching tubular member is nestably interconnected with another essentially identical attaching tubular member, said attaching means attaches said essentially identical attaching tubular members and substantially prevents said essentially identical attaching tubular members from movement with respect to each other along said longitudinal axis such that when a plurality of said mats is substantially vertically stacked on top of each other, the lower end of said at least one attaching tubular member in a higher one of said mats nestably interconnects in the associated upper end of said at least one essentially identical attaching tubular member in the mat immediately therebeneath and said attaching means attaches said at least one attaching member in a higher one of said mats to said at least one substantially identical attaching tubular member in the mat immediately therebeneath;

(b) a substantially fluid impermeable covering substantially completely surrounding said vertically stacked mats; and (c) at least one port extending through said covering whereby fluid is permitted to pass between the interior and exterior of the region substantially completely surrounded by said covering.

19. The system according to claim 18 wherein said tubular members of each of said mats are disposed in a substantially uniform rectangular array defined by a plurality of substantially perpendicular rows and columns, wherein the number of said tubular members in a row is one-half the number of said tubular members in a column, thereby defining a length and a shorter width of each of said mats, with a longitudinal length and opposing longitudinal ends along the length of each of said mats, and wherein said mats are layered such that the longitudinal lengths of at least some of said mats in one layer are perpendicular to the longitudinal lengths of at least some of said mats in an immediately adjacent layer.

20. A system according to claim 19 wherein said fluid consists essentially of water.

21. A tubular segment having a substantially longitudinal axis and configured for nestable interconnection with another essentially identical tubular segment, whereby when said tubular segment is nestably interconnected with another essentially identical tubular segment, both said tubular segments are substantially aligned along said longitudinal axis, said tubular segment including:

an upper end and a lower end, said lower end being configured to longitudinally extend into the upper end of another essentially identical tubular segment, and means for attaching adjacent, aligned nestably interconnected tubular segments, whereby when said tubular segment is nestably interconnected with another essentially identical tubular segment, said nestably connected tubular segments are attached and substantially prevented from movement with respect to each other along said longitudinal axis.

* * * * *